US008772678B2

(12) United States Patent
Shigeoka et al.

(10) Patent No.: US 8,772,678 B2
(45) Date of Patent: Jul. 8, 2014

(54) COOKTOP WITH LIGHT EMITTING INDICATORS

(75) Inventors: Takehiko Shigeoka, Nara (JP); Akira Kataoka, Shiga (JP); Eiji Matsui, Osaka (JP)

(73) Assignee: Panasonic Corporation, Osaka (JP)

( * ) Notice: Subject to any disclaimer, the term of this patent is extended or adjusted under 35 U.S.C. 154(b) by 199 days.

(21) Appl. No.: 13/386,621

(22) PCT Filed: Jul. 2, 2010

(86) PCT No.: PCT/JP2010/004348

§ 371 (c)(1),
(2), (4) Date: Jan. 23, 2012

(87) PCT Pub. No.: WO2011/010428

PCT Pub. Date: Jan. 27, 2011

(65) Prior Publication Data

US 2012/0118870 A1 May 17, 2012

(30) Foreign Application Priority Data

Jul. 24, 2009 (JP) ..... 2009-172692

(51) Int. Cl.
*H05B 3/68* (2006.01)

(52) U.S. Cl.
USPC ..... 219/445.1; 219/220

(58) Field of Classification Search
USPC ..... 219/443.1, 460.1, 461.1, 465.1, 452.11, 219/220, 620–622, 462.1, 466.1, 467.1, 219/468.41, 640, 649, 720, 445, 445.1; 99/DIG. 14
See application file for complete search history.

(56) References Cited

U.S. PATENT DOCUMENTS

| | | | | |
|---|---|---|---|---|
| 3,552,297 | A * | 1/1971 | Williams | 99/468 |
| 6,614,419 | B1 * | 9/2003 | May | 345/156 |
| 6,660,981 | B2 * | 12/2003 | Ogata et al. | 219/622 |
| 6,969,834 | B2 * | 11/2005 | Kaji et al. | 219/620 |
| 7,041,945 | B2 * | 5/2006 | Aihara et al. | 219/622 |

(Continued)

FOREIGN PATENT DOCUMENTS

| | | |
|---|---|---|
| JP | 59-65404 U | 5/1984 |
| JP | 05-33947 A | 2/1993 |

(Continued)

OTHER PUBLICATIONS

International Search Report for International Application No. PCT/JP2010/004348, dated Oct. 26, 2010, 2 pages.

(Continued)

*Primary Examiner* — Henry Yuen
*Assistant Examiner* — John J Norton
(74) *Attorney, Agent, or Firm* — Brinks Gilson & Lione

(57) ABSTRACT

A heating cooker of the present invention is structured such that, an indicator sheet of a light emitting indicator unit has a light transmitting portion that transmits light of a light emission source and a light blocking portion that is provided away from a heating unit than the light transmitting portion is and that blocks the light of the light emission source, and that the light emission source is disposed below the light blocking portion. Thus, uneven shining of the indicator sheet can be suppressed, and the effect of heat from a heating target cooking vessel to the light emission source can be suppressed, whereby a further reduction in thickness of the heating cooker can be realized.

12 Claims, 9 Drawing Sheets

(56) References Cited

U.S. PATENT DOCUMENTS

| | | | | |
|---|---|---|---|---|
| 7,109,450 | B2 * | 9/2006 | Kaji et al. | 219/620 |
| 7,402,781 | B2 * | 7/2008 | Kondo et al. | 219/622 |
| 2006/0091135 | A1 | 5/2006 | Kondo et al. | |
| 2012/0118281 | A1 * | 5/2012 | Shigeoka et al. | 126/1 R |
| 2012/0118714 | A1 * | 5/2012 | Shigeoka et al. | 200/181 |

FOREIGN PATENT DOCUMENTS

| | | | |
|---|---|---|---|
| JP | 11-101666 | A | 4/1999 |
| JP | 2004-171855 | A | 6/2004 |
| JP | 2004-247186 | A | 9/2004 |
| JP | 2009218040 | A * | 9/2009 |
| JP | 2009-283220 | A | 12/2009 |
| WO | WO 2004/023846 | A1 | 3/2004 |
| WO | WO 2004023846 | A1 * | 3/2004 |

OTHER PUBLICATIONS

International Preliminary Report on Patentability in corresponding International Application No. PCT/JP2010/004348, dated Mar. 15, 2012, 5 pages.

* cited by examiner

COOKTOP WITH LIGHT EMITTING INDICATORS

This application is a 371 application of PCT/JP2010/004348 having an international filing date of Jul. 2, 2010, which claims priority to JP2009-172692 filed on Jul. 24, 2009, the entire contents of which are incorporated herein by reference.

TECHNICAL FIELD

The present invention relates to a heating cooker including a light emitting indicator unit that indicates the position at which a heating target cooking vessel is to be placed, or that indicates that the heating unit is in the heating state.

BACKGROUND ART

In recent years, the opening and closing manner of a storage unit of a kitchen cabinet has been shifting from the door type to the drawer type in order to improve the usability. Further, a storage unit is also provided below a heating cooker such as an induction heating cooker, which is conventionally installed in a kitchen cabinet. Here, as to such a storage unit also, a drawer type storage unit is becoming popular. There is demand for a kitchen cabinet securing a further greater storage capacity. In order to secure a greater capacity of the storage unit below the heating cooker, development of a thin heating cooker that does not project toward the storage unit is desired.

An exemplary conventional heating cooker is disclosed in Patent Document 1 (Japanese Unexamined Patent Publication No. 2004-247186). FIG. 12 is a plan view of a conventional heating cooker. FIG. 13 is a cross-sectional view of the heating cooker shown in FIG. 12. FIG. 14 is a cross-sectional view of a light emitting indicator unit included in the heating cooker shown in FIG. 12. FIG. 15 is a perspective view showing the state in which the heating cooker shown in FIG. 12 is installed in a kitchen cabinet.

As shown in FIGS. 13 and 15, the conventional heating cooker includes a box-like body 61 having an opening at its top portion, and a flat plate-like top board 62 that is disposed to close the opening of the body 61, on which a heating target cooking vessel (not shown) such as a pot is placed.

As shown in FIG. 13, one or more heating units 63 are disposed inside the body 61. Each of the heating units 63 is structured with, for example, a substantially circular induction heating coil that heats the heating target cooking vessel via the top board 62. Below each heating unit 63, a control device 64 that controls the output of the heating unit 63 is provided. Further, beside each heating unit 63, a light emitting indicator unit 65 is provided. Each light emitting indicator unit 65 indicates the position at which the heating target cooking vessel is to be placed or indicates that the heating unit 63 is in the heating state, when the heating target cooking vessel is heated by the heating unit 63.

As shown in FIG. 14, each of the light emitting indicator units 65 includes a box-like body 66 having a light blocking characteristic, and a light emission source 67 disposed on the inner face of the bottom wall of the box-like body 66. The light emission source 67 is structured with a point light source such as a lead type bullet LED. The box-like body 66 is disposed such that its top portion faces the top board 62. An opening 68 is provided at the top portion of the box-like body 66, and the opening 68 is covered by an indicator sheet 69. The indicator sheet 69 is structured with a translucent material so that it is illuminated by the light emitted from the light emission source 67 and passed through the opening 68, and shines in its entirety. The light emission source 67 and the indicator sheet 69 are disposed to have a space therebetween such that uneven shining of the indicator sheet 69 is reduced.

Patent Document 1: Japanese Unexamined Patent Publication No. 2004-247186

SUMMARY OF THE INVENTION

Problems to be Solved by the Invention

In order to reduce in thickness of the conventional heating cooker described above, it is considered to be effective to suppress the height of each light emitting indicator unit 65. In order to suppress the height of each light emitting indicator unit 65, the space between the light emission source 67 and the indicator sheet 69 may be narrowed.

However, when the space between the light emission source 67 and the indicator sheet 69 is narrowed, since the light emission source 67 is a point light source, uneven shining of the indicator sheet 69 becomes great, and the appearance is impaired.

Further, in a case where the heating target cooking vessel becomes empty while being heated, the temperature of the heating target cooking vessel rises to approximate, e.g., 300° C. Here, when the heat of the heating target cooking vessel is transferred to the light emitting indicator units 65, the light emission source 67 deteriorates, whereby the brightness is reduced and the lifetime is shortened.

In order to reduce the effect of the heat from the heating target cooking vessel, the indicator sheet 69 disposed between the light emission source 67 and the top board 62 may be structured with a heat insulating material. However, since the heat insulating material absorbs light, it cannot fully function as the indicator sheet 69.

Therefore, the light emission source 67 is required to be disposed to be as far as possible from the heating target cooking vessel. On the other hand, the indicator sheet 69 is required to be disposed near the top board 62 so as to be seen by the user. That is, it is difficult to suppress the height of each light emitting indicator unit 65 by narrowing the space between the light emission source 67 and the indicator sheet 69.

Accordingly, an object of the present invention is to solve the issue stated above, and to provide a heating cooker including a light emitting indicator unit which is capable of achieving a further reduction in thickness.

Means for Solving the Problems

In order to achieve the object stated above, the present invention is structured as follows.

According to a first aspect of the present invention, there is provided a heating cooker, comprising:

a box-like body having an opening at top portion of the box;

a top board that is provided to close the opening of the body;

a heating unit that is provided inside the body and that heats a heating target cooking vessel placed on the top board; and a light emitting indicator unit that is provided beside the heating unit, wherein the light emitting indicator unit includes:

a case that has an opening at top portion of the case facing the top board;

a light emission source that is provided in the case; and an indicator sheet that is provided to close the opening of the case, wherein the indicator sheet has:

a light transmitting portion that passes light of the light emission source; and a light blocking portion that is provided at a position away from the heating unit than the light transmitting portion is, the blocking portion blocking the light of the light emission source, and wherein the light emission source is disposed below the light blocking portion.

According to a second aspect of the present invention, there is provided the heating cooker as defined in first aspect, wherein the case has a bottom wall in a substantially isosceles triangular shape, the case being disposed such that a base side of the substantially isosceles triangular shape faces an outer circumferential portion of the heating unit, and the light emission source is disposed near an apex being away from the base of the bottom wall.

According to a third aspect of the present invention, there is provided the heating cooker as defined in second aspect, wherein the heating unit has the outer circumferential portion formed to be substantially circular, and the base of the bottom wall is formed to be arc-shaped so as to conform to the outer circumferential portion of the heating unit.

According to a fourth aspect of the present invention, there is provided the heating cooker as defined in first aspect, wherein the light emitting indicator unit has a light blocking wall that blocks the light of the light emission source between the light transmitting portion of the indicator sheet and the light emission source as seen from a height direction.

According to a fifth aspect of the present invention, there is provided the heating cooker as defined in fourth aspect, wherein the light blocking wall is provided in a standing manner from the bottom wall of the case, and a clearance that passes the light of the light emission source is provided between the light blocking wall and the indicator sheet.

According to a sixth aspect of the present invention, there is provided the heating cooker as defined in fifth aspect, wherein the light blocking wall is formed such that the clearance becomes greater as a distance from the light emission source becomes greater, and that a height from the bottom wall becomes smaller as the distance from the light emission source becomes greater.

According to a seventh aspect of the present invention, there is provided the heating cooker as defined in fourth aspect, wherein the light blocking wall is provided with a bypass portion that passes the light from the light emission source.

According to an eighth aspect of the present invention, there is provided the heating cooker as defined in first aspect, wherein the indicator sheet is removably attached to the case.

According to a ninth aspect of the present invention, there is provided the heating cooker as defined in first aspect, wherein the light emission source is a surface mount LED.

According to a 10th aspect of the present invention, there is provided the heating cooker as defined in first aspect, wherein the light emission source is a surface mount LED that emits light in a plurality of colors.

According to an 11th aspect of the present invention, there is provided the heating cooker as defined in first aspect, wherein the heating unit has an outer circumferential portion formed to be substantially circular, the light transmitting portion of the indicator sheet is arc-shaped so as to conform to the outer circumferential portion of the heating unit, the light emission source has a plurality of surface mount LEDs that produce colors being different from one another, and a plurality of the LEDs are aligned in a direction that passes a midpoint of a straight line connecting between opposite ends of the light transmitting portion and that is perpendicular to the straight line.

According to a 12th aspect of the present invention, there is provided the heating cooker as defined in first aspect, wherein the case is formed with a light reflecting material that reflects off the light of the light emission source.

According to a 13th aspect of the present invention, there is provided the heating cooker as defined in first aspect, wherein a face of the light blocking portion of the indicator sheet on the light emission source side is subjected to a light reflection process for reflecting off the light of the light emission source.

According to a 14th aspect of the present invention, there is provided the heating cooker as defined in 13th aspect, wherein the face of the light blocking portion of the indicator sheet on the light emission source side is provided with white color printing as the light reflection process.

According to a 15th aspect of the present invention, there is provided the heating cooker as defined in first aspect, wherein the light transmitting portion of the indicator sheet is provided with a light diffusion process for diffusing the light of the light emission source.

Effects of the Invention

With the heating cooker of the present invention, the light emission source is disposed below the light blocking portion of the indicator sheet, such that the light of the light emission source cannot directly be seen from the light transmitting portion of the indicator sheet. That is, the light transmitting portion of the indicator sheet is indirectly illuminated by the light of the light emission source. Thus, uneven shining of the indicator sheet can drastically be suppressed.

Further, with the heating cooker of the present invention, since the light blocking portion is provided at the position away from the heating unit than the light transmitting portion is, the light emission source disposed below the light blocking portion is disposed to be away from the heating target cooking vessel disposed above the heating unit. Accordingly, the effect of the heat from the heating target cooking vessel to the light emission source becomes small, and a reduction in brightness or lifetime of the light emission source can be suppressed.

Accordingly, with the heating cooker of the present invention, the space between the light emission source and the indicator sheet can be narrowed, and hence, the height of the light emitting indicator unit can be suppressed and a further reduction in thickness of the heating cooker can be realized.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
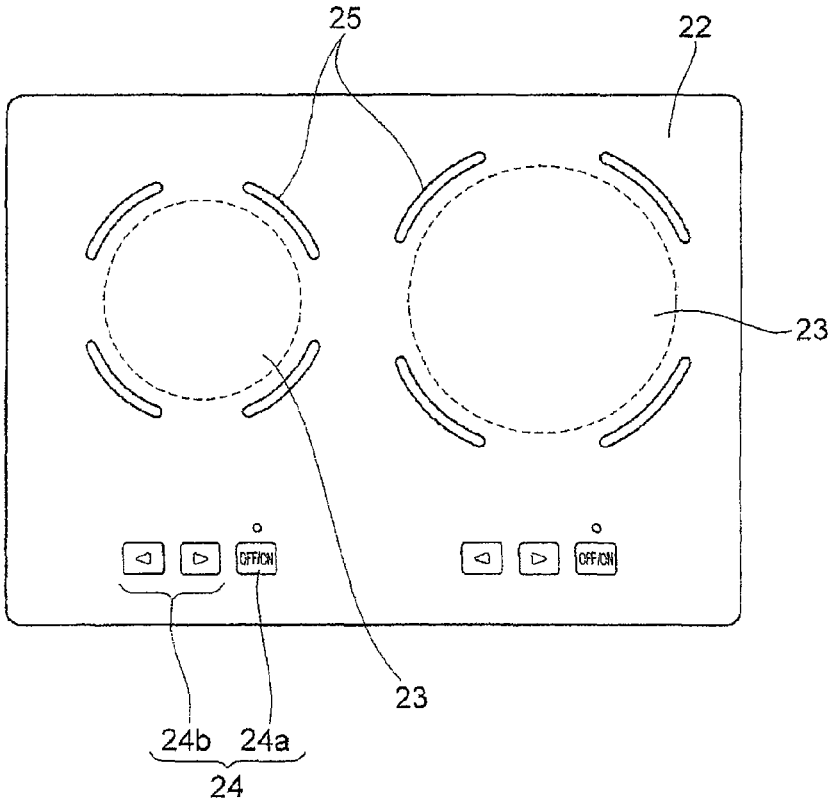
FIG. 1 is a plan view of a heating cooker according to a first embodiment of the present invention.

Before the description of the present invention proceeds, it is noted that like parts are designated by like reference numerals throughout the accompanying drawings.

In the following, a description will be given of embodiments of the present invention with reference to the drawings. Note that the present invention is not limited by the embodiments.

First Embodiment

Figure 2:
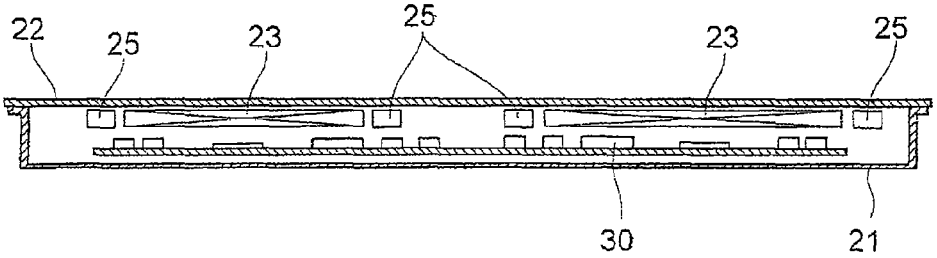
FIG. 2 is a cross-sectional view of the heating cooker according to the first embodiment of the present invention.
Figure 3:
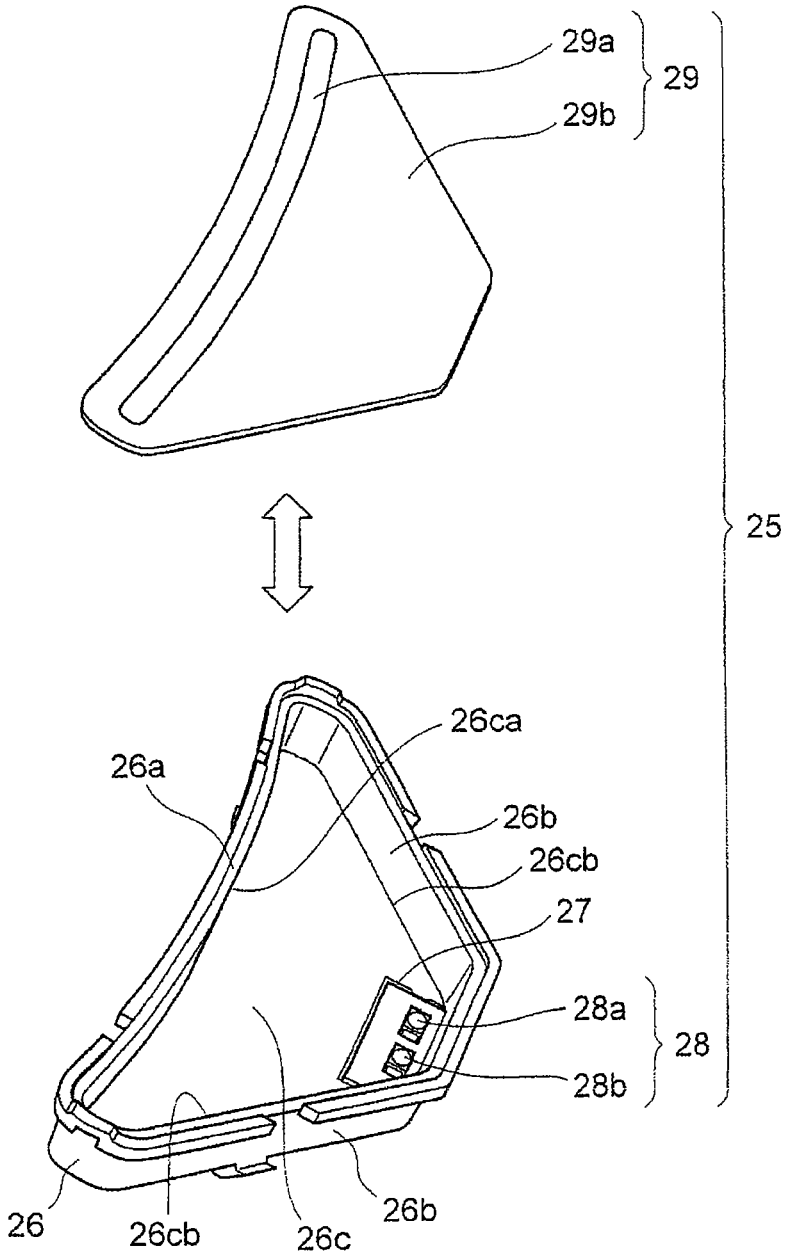
FIG. 3 is an exploded perspective view of a light emitting indicator unit of the heating cooker according to the first embodiment of the present invention.
Figure 4:
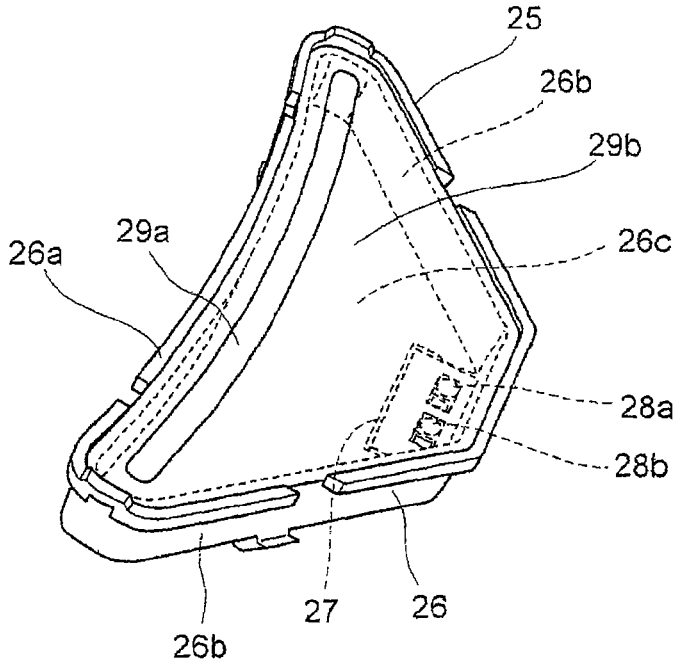
FIG. 4 is an assembly perspective view of the light emitting indicator unit of the heating cooker according to the first embodiment of the present invention.
Figure 5:
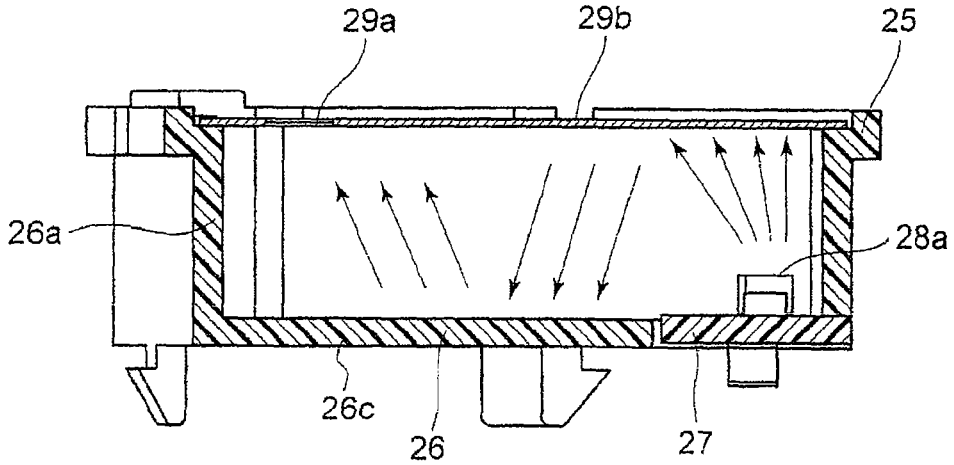
FIG. 5 is a cross-sectional view of the light emitting indicator unit of the heating cooker according to the first embodiment of the present invention.

With reference to FIGS. 1 to 5, a description will be given of a heating cooker according to a first embodiment of the present invention. FIG. 1 is a plan view of the heating cooker according to the first embodiment. FIG. 2 is a cross-sectional view of the heating cooker according to the first embodiment. FIG. 3 is an exploded perspective view of a light emitting indicator unit of the heating cooker according to the first embodiment. FIG. 4 is an assembly perspective view of the light emitting indicator unit of the heating cooker according to the first embodiment. FIG. 5 is a cross-sectional view of the light emitting indicator unit of the heating cooker according to the first embodiment.

As shown in FIG. 1 or FIG. 2, the heating cooker according to the first embodiment includes a box-like body 21 having an opening at the top portion, and a flat plate-like top board 22 provided to close the opening of the body 21 on which a heating target cooking vessel (not shown) such as a pot is placed.

Inside the body 21, one or more heating units 23 are disposed. FIGS. 1 and 2 each show an example where two heating units 23 are provided. Each of the heating units 23 is structured with, for example, an induction heating coil that heats the heating target cooking vessel via the top board 22. The output of the heating unit 23 can be adjusted by manipulating an operation button 24*a* and a manipulation button 24*b* of a manipulation unit 24 provided at the top board 22.

Beside each heating unit 23, one or more light emitting indicator units 25 are provided so as to conform to the substantially circular outer circumferential portion of the heating unit 23. The light emitting indicator units 25 indicate the position at which the heating target cooking vessel is to be placed when the heating target cooking vessel is heated by the heating unit 23, or the state that the heating unit 23 is in the heating state. FIG. 1 shows an example where four light emitting indicator units 25 are disposed at equal intervals for one heating unit 23. It is noted that, in a case where a single light emitting indicator unit 25 is provided, the light emitting indicator unit 25 may be formed to be ring-shaped, so as to conform to the outer circumferential portion of the heating unit 23.

As shown in FIGS. 3 to 5, each of the light emitting indicator units 25 includes a case 26 that has a light blocking characteristic, and a light emission source 28 that is provided in the case 26.

The case 26 is provided so that its top portion faces the top board 22. The top board 22 is structured such that at least a portion facing the top portion of the case 26 transmits light. A bottom wall 26*c* of the case 26 is substantially isosceles triangular. The case 26 is disposed such that the base 26*ca* side of the substantially isosceles triangular shape faces the outer circumferential portion of the heating unit 26. It is noted that the "substantial isosceles triangle" includes not only a perfect isosceles triangle, but also isosceles triangles being deformed, e.g., having their corners rounded or cut off, or having their sides formed to be arc-shaped. That is, the bottom wall 26*c* of the case 26 is only required to be in a shape that can generally be recognized as an isosceles triangle.

The base 26*ca* of the bottom wall 26*c* of the case 26 is formed to be arc-shaped so as to conform to the substantially circular outer circumferential portion of the heating unit 23. The base 26*ca* is provided with a reflective wall 26*a*, which is part of the outer circumferential wall (sidewall), in a standing manner. That is, the reflective wall 26*a* is formed to be arc-shaped so as to conform to the substantially circular outer circumferential portion of the heating unit 23.

The two equilateral sides 26*cb* and 26*cb* of the bottom wall 26*c* of the case 26 are each provided with a guide wall 26*b*, which is the other portion of the outer circumferential wall, in a standing manner. A substrate 27 is arranged near the apex being away from the base 26*ca* of the bottom wall 26*c*. On the substrate 27, the light emission source 28 is disposed (mounted).

The light emission source 28 has one or more point light sources. FIGS. 3 to 5 each show an example where two surface mount LEDs 28*a* and 28*b* are provided as point light sources. Here, an LED that emits white light is used as one LED 28*a*, and an LED that emits red light is used as the other LED 28*b*.

An opening is provided at the top portion of the case 26, and the opening is closed by an indicator sheet 29. The indicator sheet 29 includes a light transmitting portion 29*a* that transmits the light of the light emission source 28, and a light blocking portion 29*b* that blocks the light of the light emission source 28. The light transmitting portion 29*a* is formed arc-shaped so as to conform to the outer circumferential portion of the substantially circular heating unit 23. The light blocking portion 29*b* is provided at the position away from the heating unit 23 further than the light transmitting portion 29*a* is. Below the light blocking portion 29*b*, the light emission source 28 is disposed. That is, the light emission source 28 is disposed so as not to position on the surface of projection of the light transmitting portion 29*a* of the indicator sheet 29 as seen from the top board 22 side.

Further, below the heating unit 23 and the light emitting indicator unit 25, a control unit 30 is provided. The control unit 30 controls the output of the heating unit 23 and the light emission timing of the light emission source 28 based on the manipulated operation button 24*a* and manipulation button 24*b* of the manipulation unit 24.

Next, a description will be given of an exemplary basic operation of the heating cooker according to the first embodiment.

First, when the operation button 24*a* is turned ON, the control unit 30 exerts control such that the LED 28*a* of the light emission source 28 of the light emitting indicator unit 25 is energized and the LED 28*a* emits white light. The light from the LED 28*a* is reflected off the inner face of the case 26 or the face of the light blocking portion 29*b* on the light emission source 28 side, and guided to the light transmitting portion 29*a*. Thus, the light transmitting portion 29*a* is indirectly illuminated by the white light of the LED 28*a*, and the position where a heating target cooking vessel is to be placed is indicated.

When the heating target cooking vessel is placed at the position where it should be and the manipulation button 24*b* is pressed, the heating unit 23 is driven as being controlled by the control unit 30, and heating of the heating target cooking vessel is started. During this heating, by the control exerted by the control unit 30, the LED 28*b* is energized in place of the LED 28*a*, and the LED 28*b* emits red light. The light of the LED 28*b* is reflected off the inner face of the case 26 or the face of the light blocking portion 29*b* on the light emission source 28 side, and guided to the light transmitting portion 29*a*. Thus, the light transmitting portion 29*a* is indirectly illuminated by the red light of the LED 28*b*, and it is indicated that the heating unit 23 is in the heating state.

Thereafter, when the operation button 24*a* is turned OFF to stop the heating of the heating target cooking vessel, by the control exerted by the control unit 30, the LED 28*b* is intermittently energized, and the LED 28*b* blinks. Thus, the light transmitting portion 29*a* is indirectly illuminated by the red light of the LED 28*b* and blinks, and it is indicated that the position at which the heating target cooking vessel is to be placed is at a high temperature. Thereafter, after a lapse of a prescribed time, or when the temperature of the top board 22 lowers to reach a prescribed temperature, by the control exerted by the control unit 30, the energization of the LED 28*b* is stopped, whereby the light transmitting portion 29*a* is put off.

As has been described, with the heating cooker according to the first embodiment, the light emission source 28 is disposed below the light blocking portion 29*b* of the indicator sheet 29, such that the light of the light emission source 28 cannot directly be seen from the light transmitting portion 29*a* of the indicator sheet 29. That is, the light transmitting portion 29*a* of the indicator sheet 29 is indirectly illuminated by the light of the light emission source 28. Thus, uneven shining of the indicator sheet 29 can drastically be suppressed.

Further, with the heating cooker according to the first embodiment, since the light blocking portion 29*b* is provided at the position away from the heating unit 23 than the light transmitting portion 29*a* is, the light emission source 28 disposed below the light blocking portion 29*b* is disposed to be away from the heating target cooking vessel disposed above the heating unit 23. Accordingly, the effect of the heat from the heating target cooking vessel to the light emission source 28 becomes small, and a reduction in brightness or lifetime of the light emission source 28 can be suppressed.

Accordingly, with the heating cooker according to the first embodiment, the space between the light emission source 28 and the indicator sheet 29 can be narrowed and the height of the light emitting indicator unit 25 can be suppressed. Thus, a further reduction in thickness of the heating cooker can be achieved.

Further, with the heating cooker according to the first embodiment, the light emission source 28 is disposed near the apex, which is away from the base 26*ca* of the bottom wall 26*c* of the case 26. That is, the light emission source 28 is disposed at the position in the case 26 farthest from the outer circumferential portion of the heating unit 23. Thus, a reduction in the effect of heat from the heating target cooking vessel to the light emission source 28 can be achieved, and a reduction in brightness or lifetime of the light emission source 28 can further be suppressed. Further, disposition of the light emission source 28 near the apex being away from the base 26*ca* allows the light of the light emission source 28 to be guided to the guide wall 26*b* provided to each of the two equilateral sides 26*cb* in a standing manner, and to arrive at the light transmitting portion 29*a* further evenly and at higher brightness. Accordingly, it becomes possible to eliminate the necessity of providing the light emission sources 28 at a plurality of places in the case 26 for the purpose of allowing the light transmitting portion 29*a* to shine evenly at high brightness.

Further, with the heating cooker according to the first embodiment, since the reflective wall 26*a* of the case 26 is formed to be arc-shaped so as to conform to the outer circumferential portion of the heating unit 23, the distance between the reflective wall 26*a* and the heating unit 23 can be reduced. Thus, when a plurality of heating units 23 are disposed next to one another, it becomes possible to reduce the distance between each ones of the heating units 23, and to structure the heating cooker in a compact manner, or to dispose more heating units 23 within the same space.

Further, with a conventional heating cooker, since the light emission source is structured with a lead type bullet LED, the height of the tip portion of the light emission source becomes the sum of the height of the LED body and that of the lead portion. In contrast, with the heating cooker according to the first embodiment, since the surface mount LEDs 28*a* and 28*b* are used as the light emission source 28, the size thereof is small and no lead portion is present. Therefore, the height of the light emission source 28 can be reduced by that amount. Thus, it becomes possible to suppress the height of the light emitting indicator unit 25 to further reduce the thickness of the heating cooker.

Further, with the heating cooker according to the first embodiment, since the light emission source 28 has the LED 28*a* that emits white light and the LED 28*b* that emits red light, the color of light shone from the light transmitting portion 29*a* can be changed in accordance with the purpose, such as indication of the position where the heating target cooking vessel is to be placed. Thus, visibility can be improved. It is noted that, the timing of the LEDs 28*a* and 28*b* for turning on, the blinking manner of the LEDs 28*a* and 28*b*, the color of emitted light, and the like are not limited to those described above, and can be set as appropriate.

It is noted that, in the heating cooker according to the first embodiment, it is preferable that the indicator sheet 29 is removably attached to the case 26. Thus, by preparing a plurality of indicator sheets 29 differing from one another in the curvature, and replacing the indicator sheets 29 of the light emitting indicator unit 25 in accordance with the outer diameter of the heating unit 23, it becomes possible to apply the light emitting indicator unit 25 to the heating unit 23 of various outer diameters. Accordingly, versatility of the light emitting indicator unit 25 can be improved. Further, since it is not necessary to change the shape of the case 26, the case 26 can be manufactured with a single mold assembly, and the manufacturing costs can be reduced. It is noted that, exemplary means for removably attaching the indicator sheet 29 to the case 26 may be bonding means using a double stick tape.

Further, in the heating cooker according to the first embodiment, it is preferable that the face of the light blocking portion 29*b* of the indicator sheet 29 on the light emission source 28 side is subjected to a light reflection process for reflecting off the light of the light emission source 28. Further, it is preferable that the case 26 is formed with a light reflecting material that reflects off the light of the light emission source 28. Thus, the amount of light of the light emission source 28 reflected off the inner face of the case 26 or the face of the light blocking portion 29*b* on the light emission source 28 side and guided to the light transmitting portion 29*a* can be increased, and the light transmitting portion 29*a* is allowed to shine evenly and at high brightness. It is noted that, an exemplary light reflection process of the face of the light blocking portion 29*b* on the light emission source 28 side may be the white color printing. Since the white pigment used for the white color printing is of high optical reflectance, by providing the white printing on the face of the light blocking portion 29*b* on the light emission source 28 side, the brightness of the light transmitting portion 29*a* can approximately be doubled.

Further, in the heating cooker according to the first embodiment, part of or the entire bottom wall 26*c* of the case 26 may be formed so as to be shared with the base to which the light emitting indicator unit 25 is attached, the substrate 27 or the like. In this case, it is preferable to provide the reflecting process also to the surface of the base, the substrate 27 or the like exposed in the case 26.

Further, in the heating cooker according to the first embodiment, it is preferable that the light transmitting portion 29*a* of the indicator sheet 29 is provided with a light diffusion process for diffusing the light of the light emission source 28. Thus, even when the light of the light emission source 28 guided to the light transmitting portion 29*a* is uneven to some extent, uneven shining of the light transmitting portion 29*a* can be suppressed and the appearance can largely be improved. It is noted that, an exemplary light diffusion process of the light transmitting portion 29*a* may be bonding of a light diffusion sheet, a grind process or the like.

Second Embodiment

Figure 6:
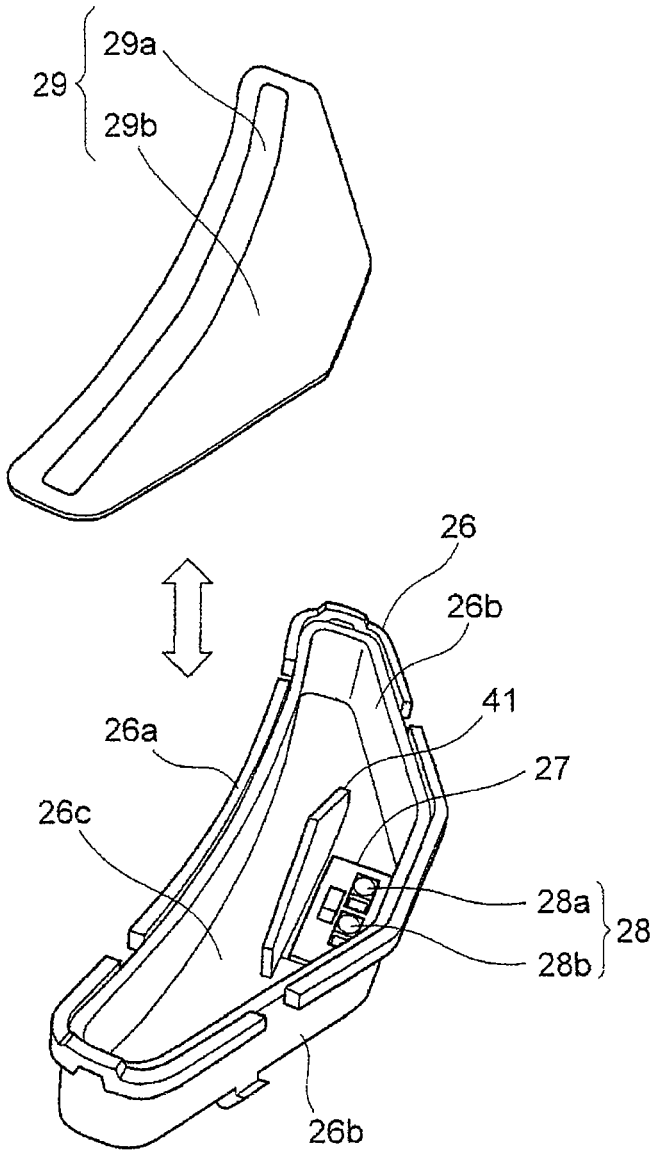
FIG. 6 is an exploded perspective view of a light emitting indicator unit of a heating cooker according to a second embodiment of the present invention.
Figure 7:
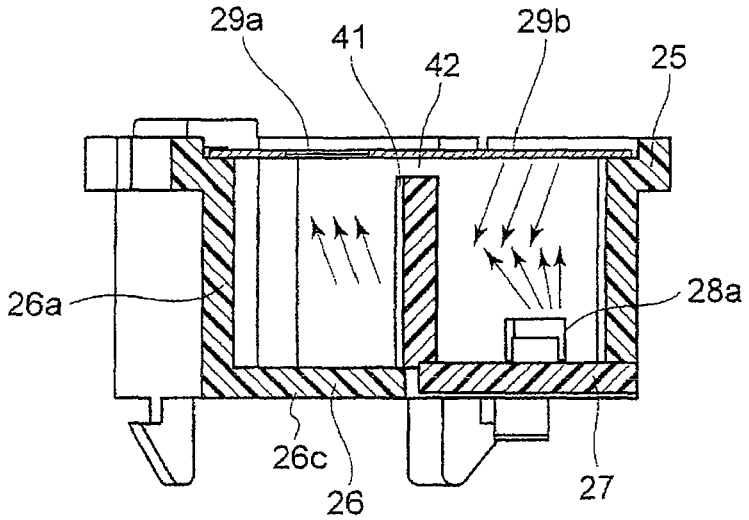
FIG. 7 is a cross-sectional view of the light emitting indicator unit of the heating cooker according to the second embodiment of the present invention.
Figure 8:
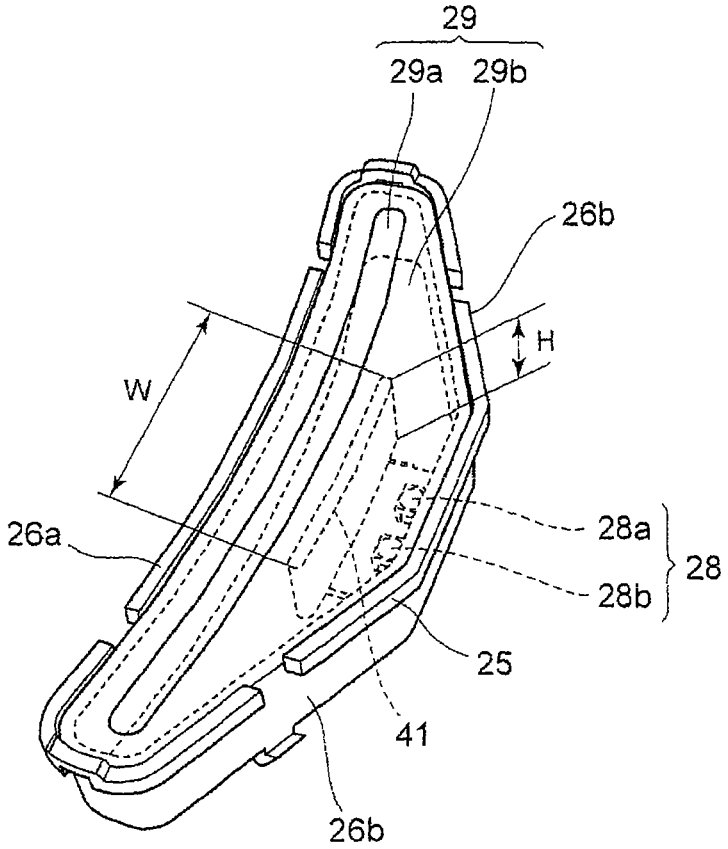
FIG. 8 is another assembly perspective view of the light emitting indicator unit of the heating cooker according to the second embodiment of the present invention.

With reference to FIGS. 6 to 8, a description will be given of a heating cooker according to a second embodiment of the present invention. FIG. 6 is an exploded perspective view of a light emitting indicator unit of the heating cooker according to the second embodiment. FIG. 7 is a cross-sectional view of the light emitting indicator unit of the heating cooker according to the second embodiment. FIG. 8 is an assembly perspective view of the light emitting indicator unit of the heating cooker according to the second embodiment. The heating cooker according to the second embodiment is different from the heating cooker according to the first embodiment in that, as seen from the height direction of the light emitting indicator unit 25, a light blocking wall 41 that blocks the light of the light emission source 28 is provided between the light transmitting portion 29*a* of the indicator sheet 29 and the light emission source 28.

In a case where the distance between the light emission source 28 and the reflective wall 26*a* is reduced for the purpose of reducing the area occupied by the light emitting indicator unit 25, the distance between the light emission source 28 and the light transmitting portion 29*a* becomes small. In this case, the proportion of the direct light, which is the light of the light emission source 28 directly arriving at the light transmitting portion 29*a*, increases, and uneven shining of the light transmitting portion 29*a* becomes great. Specifically, while the portion near the light emission source 28 of the light transmitting portion 29*a* brightens up, the end portion away from the light emission source 28 of the light transmitting portion 29*a* darkens.

Therefore, with the heating cooker according to the second embodiment, the light blocking wall 41 is provided between the light transmitting portion 29*a* and the light emission source 28 as seen from the height direction of the light emitting indicator unit 25. By adjusting the size of the light blocking wall 41, the direct light, which is the light of the light emission source 28 directly arriving at the light transmitting portion 29*a*, can be reduced, and brightness balance between the portion near the light emission source 28 of the light transmitting portion 29*a* and the end portion being away from the light emission source 28 of the light transmitting portion 29*a* can be adjusted. Accordingly, even in a case where the distance between the light emission source 28 and the light transmitting portion 29*a* is reduced, uneven shining of the light transmitting portion 29*a* can be suppressed.

It is noted that, in a case where the light blocking wall 41 is provided, the portion near the light blocking wall 41 of the light transmitting portion 29*a* tends to darken. This becomes specifically significant, particularly when the height H and the width W of the light blocking wall 41 are increased.

Therefore, it is preferable to provide a clearance 42 between the light blocking wall 41 and the indicator sheet 29 for allowing the light of the light emission source 28 to pass. By adjusting the size of the clearance 42, brightness of the portion near the light emission source 28 of the light transmitting portion 29*a* can be adjusted.

Further, as shown in FIGS. 6 and 8, it is preferable that the light blocking wall 41 is formed such that the clearance 42 becomes greater as the distance from the light emission source 28 becomes greater, and that the height H becomes smaller as the distance from the light emission source 28 becomes greater. Thus, it becomes possible to increase the amount of light of the light emission source 28 passing through the clearance 42 to be greater as the light propagates from the portion near the light emission source 28 of the light transmitting portion 29*a* toward the end portion away from the light emission source 28 of the light transmitting portion 29*a*. Hence, it becomes possible to further suppress uneven shining of the light transmitting portion 29*a*.

It is noted that the light blocking wall 41 is preferably provided in a standing manner from the bottom wall 26*c* of the case 26. Thus, the case 26 and the light blocking wall 41 can integrally be molded, and can be manufactured with ease.

Third Embodiment

Figure 9:
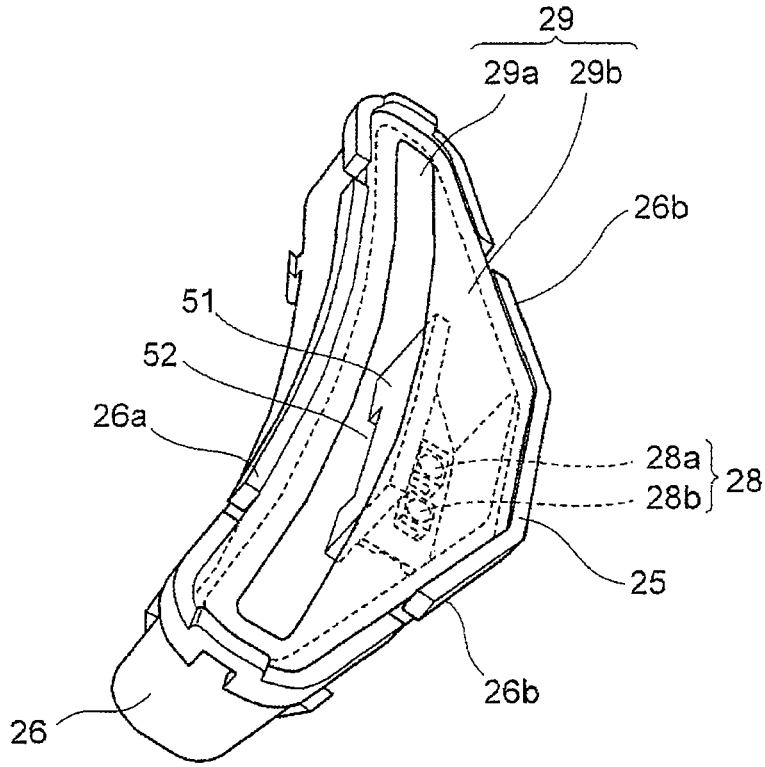
FIG. 9 is an assembly perspective view of a light emitting indicator unit of a heating cooker according to a third embodiment of the present invention.
Figure 10:
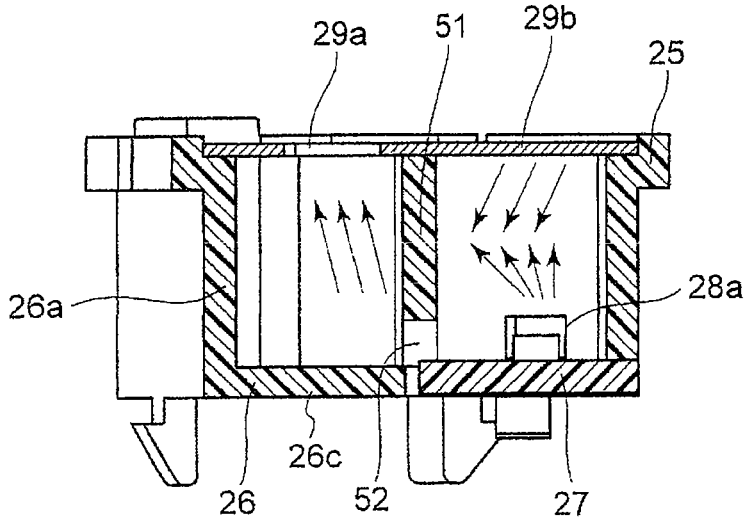
FIG. 10 is a cross-sectional view of the light emitting indicator unit of the heating cooker according to the third embodiment of the present invention.

With reference to FIGS. 9 and 10, a description will be given of a heating cooker according to a third embodiment of the present invention. FIG. 9 is a cross-sectional view of a light emitting indicator unit of the heating cooker according to the third embodiment. FIG. 10 is a cross-sectional view of the light emitting indicator unit of the heating cooker according to the third embodiment. The heating cooker according to the third embodiment is different from the heating cooker according to the second embodiment in that a light blocking wall 51 is provided between the indicator sheet 29 and the bottom wall 26*c* of the case 26 without providing the clearance 42.

When the clearance 42 is provided between the indicator sheet 29 and the light blocking wall 41 as in the second embodiment, since the indicator sheet 29 and the light blocking wall 41 are separate components, the size of the clearance 42 may be varied. In this case, a substantial amount of uneven shining occurs at the light transmitting portion 29*a*.

Therefore, in the third embodiment, a bypass portion 52 that penetrates the light blocking wall 51 in the thickness direction and that passes the light from the light emission source 28 is formed at the light blocking wall 51. Thus, the amount of light of the light emission source 28 passing through the light blocking wall 51 can be stabilized, and uneven shining of the light transmitting portion 29*a* can further be suppressed.

It is noted that, in FIGS. 9 and 10, while the bypass portion 52 is provided at the bottom portion of the light blocking wall 51, the present invention is not limited thereto. For example, the bypass portion 52 may be provided at the central portion of the light blocking wall 51.

It is noted that the present invention is not limited to the embodiments described above, and can be practiced in other various manners. For example, though the examples in which the light emission source 28 has the two LEDs 28*a* and 28*b* have been described in the foregoing, the present invention is not limited thereto. For example, the light emission source 28 may be structured to have three or more LEDs emitting colors being different from one another. In this case, it becomes possible to allow the light transmitting portion 29*a* to shine in various colors. By changing the shining color of the light transmitting portion 29*a* in accordance with the purpose, visibility can further be improved.

Further, in the foregoing, only one of the LEDs 28*a* and 28*b* is turned on or blinked, and not both of them are turned on. However, the present invention is not limited thereto, and both of the LEDs 28*a* and 28*b* may be turned on. By simultaneously causing both the LED 28*a* that emits white light and the LED 28*b* that emits red light to turn on, it becomes possible to allow the light transmitting portion 29*a* to shine in pink. That is, with the two LEDs 28*a* and 28*b*, it becomes possible to allow the light transmitting portion 29*a* to shine in three colors, namely, white, red, and pink.

It is noted that, when the LEDs 28*a* and 28*b* are simultaneously turned on, for example as shown in FIG. 6, when the LEDs 28*a* and 28*b* are aligned substantially in parallel to the extending direction of the light transmitting portion 29*a*, the opposite ends of the light transmitting portion 29*a* are different from each other in color. That is, while the end of the light transmitting portion 29*a* on the LED 28*a* side shines in pale pink, the end of the light transmitting portion 29*a* on the LED 28*b* side shines in deep pink. Accordingly, uneven shining occurs at the light transmitting portion 29*a*, whereby the appearance is impaired.

Figure 11:
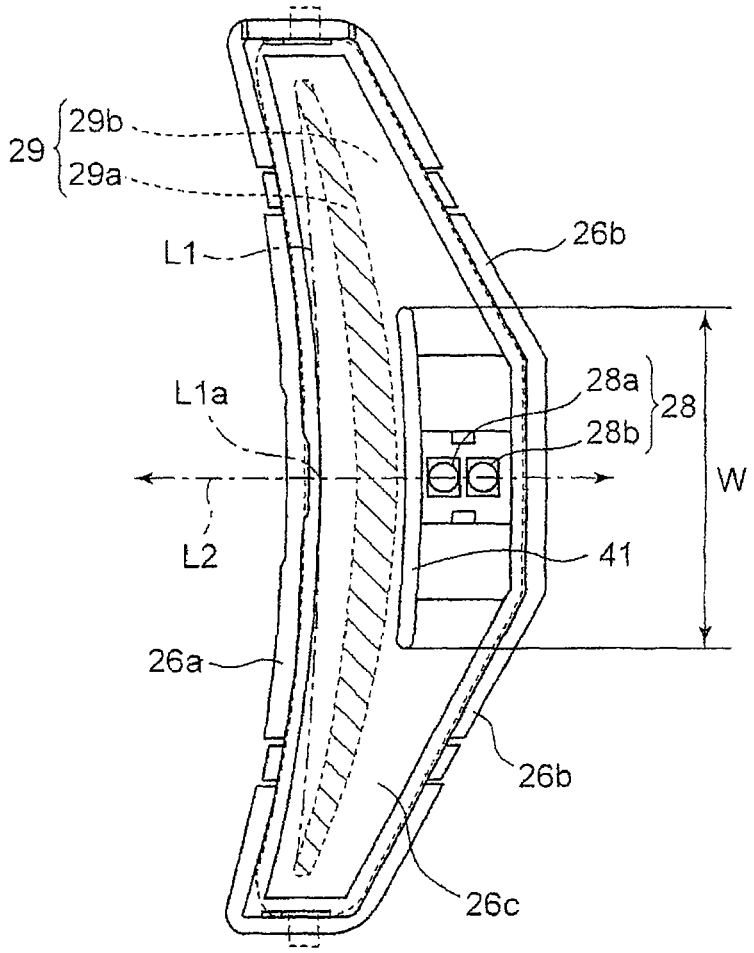
FIG. 11 is a plan view showing a preferable arrangement of a light emission source included in the light emitting indicator unit.
Figure 12:
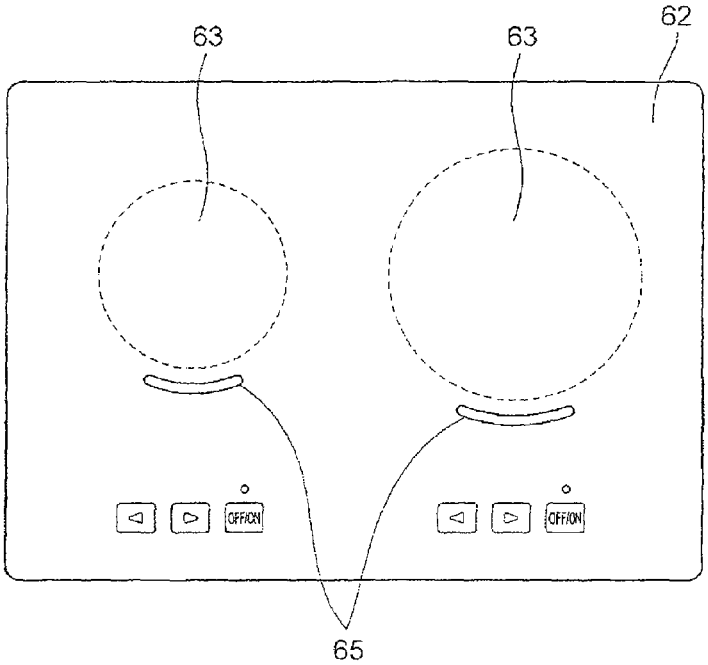
Fig. 12 Prior Art
FIG. 12 is a plan view of a conventional heating cooker.
Figure 13:
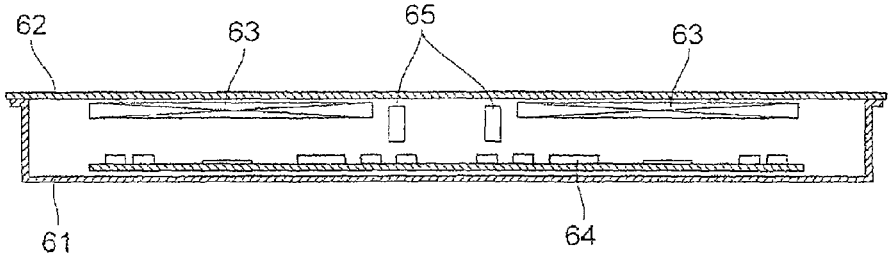
Fig. 13 Prior Art
FIG. 13 is a cross-sectional view of the conventional heating cooker.
Figure 14:
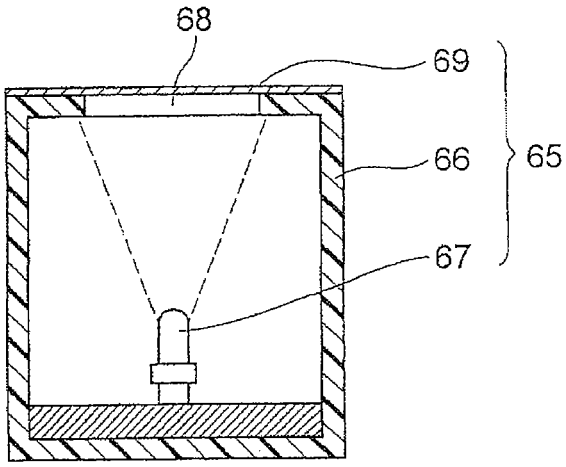
Fig. 14 Prior Art
FIG. 14 is a cross-sectional view of a light emitting indicator unit of the conventional heating cooker.
Figure 15:
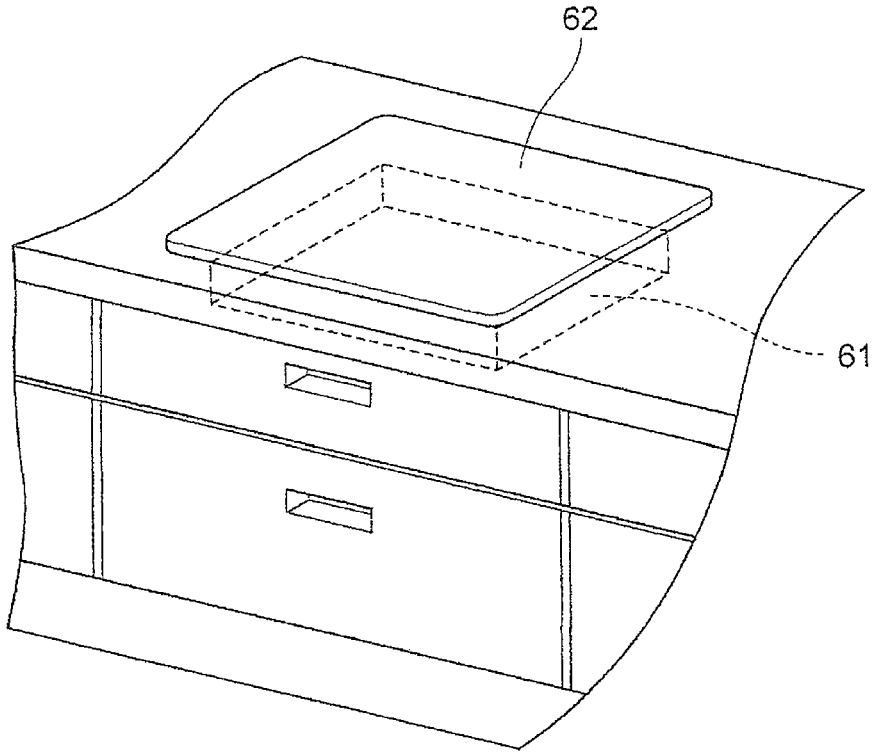
Fig. 15 Prior Art
FIG. 15 is a perspective view showing a state where the conventional heating cooker is installed in a kitchen cabinet.

Therefore, as shown in FIG. 11, it is preferable that the LEDs 28*a* and 28*b* are aligned in a direction L2 that passes through a midpoint L1*a* of a straight line L1 connecting between the opposite ends of the light transmitting portion 29*a* and that is perpendicular to the straight line L1. Thus, uneven shining of the light transmitting portion 29*a* can be suppressed, to thereby improve the appearance.

It is noted that, when the light emission source 28 is structured with three LEDs that emit light in three colors, respectively, namely red, blue, and green, it becomes possible to allow the light transmitting portion 29*a* to shine in substantially every color. Further, the light emission source 28 can be structured with a single LED that emits light in a plurality of colors (e.g., red, blue, and green).

Further, though it has been described that the light blocking wall 51 has only the light blocking characteristic, the present invention is not limited thereto. For example, it is also possible to form the light blocking wall 51 with a heat insulating material or the like such that the light blocking wall 51 has both the light blocking characteristic and the heat blocking characteristic. Thus, the effect of heat from the heating target cooking vessel to the light emission source 28 can further be reduced, and a reduction in the brightness or lifetime of the light emission source 28 can further be suppressed.

It is noted that, appropriate combinations of any of the foregoing various embodiments can exhibit their respective effects.

INDUSTRIAL APPLICABILITY

The heating cooker of the present invention is a heating cooker that includes a light emitting indicator unit and that is capable of realizing a further reduction in thickness. Therefore, it is particularly useful as an induction heating cooker installed in a kitchen cabinet.

Although the present invention has been fully described in connection with the preferred embodiments thereof with reference to the accompanying drawings, it is noted that various changes and modifications are apparent to those skilled in the art. Such changes and modifications are to be understood as included within the scope of the present invention as defined by the appended claims unless they depart therefrom.

The entire disclosure of Japanese Patent Application No. 2009-172692 filed on Jul. 24, 2009, including specification, claims, drawings, and summary are incorporated herein by reference in its entirety.

The invention claimed is:

1. A heating cooker comprising:

a box-like body having an opening at a top portion thereof;

a top board closing the opening of the body;

a heating unit inside the body that heats a heating target cooking vessel on the top board; and a light emitting indicator unit beside the heating unit, wherein the light emitting indicator unit includes:

a case having an opening at an upper portion of the case facing the top board;

a light emission source in the case; and an indicator sheet closing the opening of the case, wherein the indicator sheet includes:

a light transmitting portion in proximity to the heating unit that passes light from the light emission source; and a light blocking portion having a main portion farther away from the heating unit than the light transmitting portion, the light blocking portion blocking the light of the light emission source, wherein the heating unit has a substantially circular outer circumferential portion, the case has a bottom surface in a substantially isosceles triangular shape, the case being disposed such that a base side of the substantially isosceles triangular shape faces the outer circumferential portion of the heating unit, the light emission source is disposed below the main portion of the light blocking portion, and is disposed near an apex away from the base side of the bottom surface of the case, and the base side of the bottom surface of the case is arc-shaped so as to conform to the outer circumferential portion of the heating unit, the case has a base wall that extends from the base side and the light transmitting portion is adjacent to the base wall.

2. The heating cooker according to claim 1, wherein the light emitting indicator unit further comprises a light blocking wall that partially blocks the light from the light emission source between the light transmitting portion of the indicator sheet and the light emission source.

3. The heating cooker according to claim 2, wherein the light blocking wall stands on the bottom surface of the case, and provides a clearance between a top of the light blocking wall and the indicator sheet that passes the light from the light emission source between the light blocking wall and the indicator sheet.

4. The heating cooker according to claim 3, wherein the clearance becomes greater as a distance from the light emission source becomes greater, and a height of the light blocking wall from the bottom surface becomes smaller as the distance from the light emission source becomes greater.

5. The heating cooker according to claim 2, wherein the light blocking wall further comprises a bypass portion in a lower or central portion of the light blocking wall that passes the light from the light emission source.

6. The heating cooker according to claim 1, wherein the indicator sheet is removably attached to the case.

7. The heating cooker according to claim 1, wherein the light emission source comprises a surface mount LED.

8. The heating cooker according to claim 1, wherein the light transmitting portion of the indicator sheet is arc-shaped between opposite ends thereof so as to conform to the outer circumferential portion of the heating unit, the light emission source includes a plurality of surface mount LEDs that produce colors that are different from one another, and a plurality of the LEDs are aligned in a direction that passes a midpoint of a straight line connecting between the opposite ends of the light transmitting portion and perpendicular to the straight line.

9. The heating cooker according to claim 1, wherein the case comprises a light reflecting material that reflects the light from the light emission source.

10. The heating cooker according to claim 1, wherein a face of the light blocking portion of the indicator sheet on the light emission source side reflects light from the light emission source.

11. The heating cooker according to claim 10, wherein the face of the light blocking portion of the indicator sheet on the light emission source side is printed with a white color that reflects the light of the light emission source.

12. The heating cooker according to claim 1, wherein the light transmitting portion of the indicator sheet comprises a light diffusion material that diffuses the light from the light emission source.

* * * * *